US009291032B2

(12) United States Patent
Greci

(10) Patent No.: US 9,291,032 B2
(45) Date of Patent: Mar. 22, 2016

(54) AUTONOMOUS FLUID CONTROL DEVICE HAVING A RECIPROCATING VALVE FOR DOWNHOLE FLUID SELECTION

(75) Inventor: Stephen Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/640,520

(22) PCT Filed: Oct. 31, 2011

(86) PCT No.: PCT/US2011/058577
§ 371 (c)(1), (2), (4) Date: Oct. 11, 2012

(87) PCT Pub. No.: WO2013/066291
PCT Pub. Date: May 10, 2013

(65) Prior Publication Data

US 2014/0231094 A1 Aug. 21, 2014

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01)

(58) Field of Classification Search
USPC ..... 166/373, 320, 316, 386, 381, 369; 137/810, 811, 813, 825, 832, 115.08, 137/115.03
See application file for complete search history.

(56) References Cited

U.S. PATENT DOCUMENTS

| | | | |
|---|---|---|---|
| 553,727 | A | 1/1896 | Van Sickle |
| 1,329,559 | A | 2/1920 | Tesla |
| 2,140,735 | A | 12/1938 | Clarke |
| 2,324,819 | A | 6/1941 | Butzbach |
| 2,762,437 | A | 9/1956 | Egan |
| 2,849,070 | A | 8/1958 | Maly |

(Continued)

FOREIGN PATENT DOCUMENTS

| | | | |
|---|---|---|---|
| CA | 2813763 | A1 | 10/2011 |
| EP | 0834342 | B1 | 1/1999 |

(Continued)

OTHER PUBLICATIONS

International Search Report and Written Opinion, PCT/US2012/032044, Mail Date Oct. 25, 2012, 9 pages.

(Continued)

*Primary Examiner* — Taras P Bemko

(57) ABSTRACT

An apparatus and method autonomously controls fluid flow in a subterranean well, as the fluid changes in a characteristic, such as viscosity, over time. An autonomous reciprocating member has a fluid flow passageway there through and a primary outlet and at least one secondary outlet. A flow restrictor, such as a viscosity dependent choke or screen, is positioned to restrict fluid flow through the primary outlet. A vortex chamber is positioned adjacent the reciprocating member. The reciprocating member moves between a first position where fluid flow is directed primarily through the primary outlet of the reciprocating member and into the primary inlet of the vortex assembly, and a second position where fluid flow is directed primarily through the at least one secondary outlet of the reciprocating member and into the at least one secondary inlet of the vortex assembly. The movement of the reciprocating member alters the fluid flow pattern in the adjacent vortex chamber.

17 Claims, 4 Drawing Sheets

(56) References Cited

U.S. PATENT DOCUMENTS

| | | | |
|---|---|---|---|
| 2,945,541 | A | 7/1960 | Maly |
| 2,981,332 | A | 4/1961 | Miller |
| 2,981,333 | A | 4/1961 | Miller |
| 3,091,393 | A | 5/1963 | Sparrow |
| 3,186,484 | A | 6/1965 | Waterman |
| 3,216,439 | A | 11/1965 | Manion |
| 3,233,621 | A | 2/1966 | Manion |
| 3,233,622 | A | 2/1966 | Boothe |
| 3,256,899 | A | 6/1966 | Dexter |
| 3,266,510 | A | 8/1966 | Wadey |
| 3,267,946 | A | 8/1966 | Adams |
| 3,282,279 | A | 11/1966 | Manion |
| 3,375,842 | A | 4/1968 | Reader |
| 3,427,580 | A | 2/1969 | Brock |
| 3,461,897 | A | 8/1969 | Kwok |
| 3,470,894 | A | 10/1969 | Rimmer |
| 3,474,670 | A | 10/1969 | Rupert |
| 3,477,506 | A | 11/1969 | Malone |
| 3,486,975 | A | 12/1969 | Ripley |
| 3,489,009 | A | 1/1970 | Rimmer |
| 3,513,865 | A | 5/1970 | Heyden |
| 3,515,160 | A | 6/1970 | Cohen |
| 3,521,657 | A | 7/1970 | Ayers |
| 3,529,614 | A | 9/1970 | Nelson |
| 3,537,466 | A | 11/1970 | Chapin |
| 3,554,209 | A | 1/1971 | Brown |
| 3,566,900 | A | 3/1971 | Black |
| 3,575,804 | A | 4/1971 | Ripley |
| 3,586,104 | A | 6/1971 | Hyde |
| 3,598,137 | A | 8/1971 | Glaze |
| 3,620,238 | A | 11/1971 | Kawahata |
| 3,638,672 | A | 2/1972 | Smith |
| 3,643,676 | A | 2/1972 | Limage |
| 3,670,753 | A | 6/1972 | Healey |
| 3,704,832 | A | 12/1972 | Fix |
| 3,712,321 | A | 1/1973 | Bauer |
| 3,717,164 | A | 2/1973 | Query |
| 3,730,673 | A | 5/1973 | Straitz |
| 3,745,115 | A | 7/1973 | Olsen |
| 3,754,576 | A | 8/1973 | Zettrestrom |
| 3,756,285 | A | 9/1973 | Johnson |
| 3,776,460 | A | 12/1973 | Fichter |
| 3,850,190 | A | 11/1974 | Carlson |
| 3,860,519 | A | 1/1975 | Weatherford |
| 3,876,016 | A | 4/1975 | Stinson |
| 3,885,627 | A | 5/1975 | Berry et al. |
| 3,895,901 | A | 7/1975 | Swartz |
| 3,927,849 | A | 12/1975 | Kovalenko |
| 3,942,557 | A | 3/1976 | Tsuchiya |
| 4,003,405 | A | 1/1977 | Haynes |
| 4,029,127 | A | 6/1977 | Thompson |
| 4,082,169 | A | 4/1978 | Bowles |
| 4,127,173 | A | 11/1978 | Watkins |
| 4,134,100 | A | 1/1979 | Funke |
| 4,138,669 | A | 2/1979 | Edison |
| 4,167,073 | A | 9/1979 | Tang |
| 4,167,873 | A | 9/1979 | Bahrton |
| 4,187,909 | A | 2/1980 | Erbstoesser |
| 4,268,245 | A | 5/1981 | Straitz, III |
| 4,276,943 | A | 7/1981 | Holmes |
| 4,279,304 | A | 7/1981 | Harper |
| 4,282,097 | A | 8/1981 | Kuepper |
| 4,286,627 | A | 9/1981 | Graf |
| 4,287,952 | A | 9/1981 | Erbstoesser |
| 4,291,395 | A | 9/1981 | Holmes |
| 4,303,128 | A | 12/1981 | Marr, Jr. |
| 4,307,204 | A | 12/1981 | Vidal |
| 4,307,653 | A | 12/1981 | Goes |
| 4,323,118 | A | 4/1982 | Bergmann |
| 4,323,991 | A | 4/1982 | Holmes |
| 4,345,650 | A | 8/1982 | Wesley |
| 4,364,232 | A | 12/1982 | Sheinbaum |
| 4,364,587 | A | 12/1982 | Samford |
| 4,385,875 | A | 5/1983 | Kanazawa |
| 4,390,062 | A | 6/1983 | Fox |
| 4,393,928 | A | 7/1983 | Warnock, Sr. |
| 4,396,062 | A | 8/1983 | Iskander |
| 4,418,721 | A | 12/1983 | Holmes |
| 4,442,903 | A | 4/1984 | Schutt |
| 4,467,833 | A | 8/1984 | Satterwhite |
| 4,485,780 | A | 12/1984 | Price |
| 4,491,186 | A | 1/1985 | Alder |
| 4,495,990 | A | 1/1985 | Titus |
| 4,518,013 | A | 5/1985 | Lazarus |
| 4,526,667 | A | 7/1985 | Parkhurst |
| 4,527,636 | A | 7/1985 | Bordon |
| 4,557,295 | A | 12/1985 | Holmes |
| 4,562,867 | A | 1/1986 | Stouffer |
| 4,570,675 | A | 2/1986 | Fenwick |
| 4,570,715 | A | 2/1986 | Van Meurs |
| 4,618,197 | A | 10/1986 | White |
| 4,648,455 | A | 3/1987 | Luke |
| 4,716,960 | A | 1/1988 | Eastlund |
| 4,747,451 | A | 5/1988 | Adams |
| 4,765,184 | A | 8/1988 | Delatore |
| 4,801,310 | A | 1/1989 | Bielefeldt |
| 4,805,407 | A | 2/1989 | Buchanan |
| 4,808,084 | A | 2/1989 | Tsubouchi |
| 4,817,863 | A | 4/1989 | Bragg |
| 4,846,224 | A | 7/1989 | Collins, Jr. |
| 4,848,991 | A | 7/1989 | Bielefeldt |
| 4,857,197 | A | 8/1989 | Young |
| 4,895,582 | A | 1/1990 | Bielefeldt |
| 4,911,239 | A | 3/1990 | Winckler |
| 4,919,201 | A | 4/1990 | Bridges |
| 4,919,204 | A | 4/1990 | Baker |
| 4,921,438 | A | 5/1990 | Godfrey |
| 4,945,995 | A | 8/1990 | Tholance |
| 4,967,048 | A | 10/1990 | Langston |
| 4,974,674 | A | 12/1990 | Wells |
| 4,984,594 | A | 1/1991 | Vinegar |
| 4,998,585 | A | 3/1991 | Newcomer |
| RE33,690 | E | 9/1991 | Adams, Jr. |
| 5,058,683 | A | 10/1991 | Godfrey |
| 5,076,327 | A | 12/1991 | Mettner |
| 5,080,783 | A | 1/1992 | Brown |
| 5,099,918 | A | 3/1992 | Bridges |
| 5,154,835 | A | 10/1992 | Demichael |
| 5,165,450 | A | 11/1992 | Marrelli |
| 5,166,677 | A | 11/1992 | Schoenberg |
| 5,184,678 | A | 2/1993 | Pechkov |
| 5,202,194 | A | 4/1993 | Vanberg |
| 5,207,273 | A | 5/1993 | Cates |
| 5,207,274 | A | 5/1993 | Streich |
| 5,228,508 | A | 7/1993 | Facteau |
| 5,251,703 | A | 10/1993 | Skinner |
| 5,279,363 | A | 1/1994 | Schultz |
| 5,282,508 | A | 2/1994 | Ellingsen |
| 5,303,782 | A | 4/1994 | Johanessen |
| 5,332,035 | A | 7/1994 | Schultz |
| 5,333,684 | A | 8/1994 | Walter |
| 5,337,808 | A | 8/1994 | Graham |
| 5,337,821 | A | 8/1994 | Peterson |
| 5,338,496 | A | 8/1994 | Talbot |
| 5,341,883 | A | 8/1994 | Ringgenberg |
| 5,343,963 | A | 9/1994 | Bouldin |
| 5,365,962 | A | 11/1994 | Taylor |
| 5,375,658 | A | 12/1994 | Schultz |
| 5,435,393 | A | 7/1995 | Brekke |
| 5,455,804 | A | 10/1995 | Query |
| 5,464,059 | A | 11/1995 | Kristiansen |
| 5,482,117 | A | 1/1996 | Kolpak |
| 5,484,016 | A | 1/1996 | Surjaatmadja |
| 5,505,262 | A | 4/1996 | Cobb |
| 5,516,603 | A | 5/1996 | Holcombe |
| 5,533,571 | A | 7/1996 | Surjaatmadja |
| 5,547,029 | A | 8/1996 | Rubbo |
| 5,570,744 | A | 11/1996 | Weingarten |
| 5,578,209 | A | 11/1996 | Weiss |
| 5,673,751 | A | 10/1997 | Head |
| 5,707,214 | A | 1/1998 | Schmidt |
| 5,730,223 | A | 3/1998 | Restarick |
| 5,803,179 | A | 9/1998 | Echols |
| 5,815,370 | A | 9/1998 | Sutton |

(56) References Cited

U.S. PATENT DOCUMENTS

| | | | |
|---|---|---|---|
| 5,839,508 | A | 11/1998 | Tubel |
| 5,868,201 | A | 2/1999 | Bussear |
| 5,893,383 | A | 4/1999 | Facteau |
| 5,896,076 | A | 4/1999 | van Namen |
| 5,896,928 | A | 4/1999 | Coon |
| 6,009,951 | A | 1/2000 | Coronado |
| 6,015,011 | A | 1/2000 | Hunter |
| 6,032,733 | A | 3/2000 | Ludwig |
| 6,078,471 | A | 6/2000 | Fiske |
| 6,098,020 | A | 8/2000 | DenBoer |
| 6,109,370 | A | 8/2000 | Gray |
| 6,109,372 | A | 8/2000 | Dorel et al. |
| 6,112,817 | A | 9/2000 | Voll |
| 6,164,375 | A | 12/2000 | Carisella |
| 6,176,308 | B1 | 1/2001 | Pearson |
| 6,179,052 | B1 | 1/2001 | Purkis |
| 6,199,399 | B1 | 3/2001 | Voorhis |
| 6,241,019 | B1 | 6/2001 | Davidson |
| 6,247,536 | B1 | 6/2001 | Leismer |
| 6,253,847 | B1 | 7/2001 | Stephenson |
| 6,253,861 | B1 | 7/2001 | Carmichael |
| 6,305,470 | B1 | 10/2001 | Woie |
| 6,315,043 | B1 | 11/2001 | Farrant |
| 6,315,049 | B1 | 11/2001 | Hickey |
| 6,320,238 | B1 | 11/2001 | Kawabata |
| 6,336,502 | B1 | 1/2002 | Surjaatmadja |
| 6,345,963 | B1 | 2/2002 | Thomin |
| 6,367,547 | B1 | 4/2002 | Towers |
| 6,371,210 | B1 | 4/2002 | Bode |
| 6,374,858 | B1 | 4/2002 | Hides |
| 6,397,950 | B1 | 6/2002 | Streich |
| 6,405,797 | B2 | 6/2002 | Davidson |
| 6,426,917 | B1 | 7/2002 | Tabanou |
| 6,431,282 | B1 | 8/2002 | Bosma |
| 6,433,991 | B1 | 8/2002 | Deaton |
| 6,450,263 | B1 | 9/2002 | Schwendemann |
| 6,464,011 | B2 | 10/2002 | Tubel |
| 6,470,970 | B1 | 10/2002 | Purkis |
| 6,497,252 | B1 | 12/2002 | Kohler |
| 6,505,682 | B2 | 1/2003 | Brockman |
| 6,516,888 | B1 | 2/2003 | Gunnarson |
| 6,540,263 | B1 | 4/2003 | Sausner |
| 6,544,691 | B1 | 4/2003 | Guidotti |
| 6,547,010 | B2 | 4/2003 | Hensley |
| 6,567,013 | B1 | 5/2003 | Purkis |
| 6,575,237 | B2 | 6/2003 | Purkis |
| 6,575,248 | B2 | 6/2003 | Zhang |
| 6,585,051 | B2 | 7/2003 | Purkis |
| 6,619,394 | B2 | 9/2003 | Soliman |
| 6,622,794 | B2 | 9/2003 | Zisk, Jr. |
| 6,627,081 | B1 | 9/2003 | Hilditch |
| 6,644,412 | B2 | 11/2003 | Bode |
| 6,668,936 | B2 | 12/2003 | Williamson, Jr. |
| 6,672,382 | B2 | 1/2004 | Schultz |
| 6,679,324 | B2 | 1/2004 | Den Boer |
| 6,679,332 | B2 | 1/2004 | Vinegar |
| 6,691,781 | B2 | 2/2004 | Grant |
| 6,695,067 | B2 | 2/2004 | Johnson |
| 6,705,085 | B1 | 3/2004 | Braithwaite |
| 6,708,763 | B2 | 3/2004 | Howard |
| 6,719,048 | B1 | 4/2004 | Ramos |
| 6,719,051 | B2 | 4/2004 | Hailey, Jr. |
| 6,725,925 | B2 | 4/2004 | Al-Ramadhan |
| 6,769,498 | B2 | 8/2004 | Hughes |
| 6,786,285 | B2 | 9/2004 | Johnson |
| 6,812,811 | B2 | 11/2004 | Robison |
| 6,817,416 | B2 | 11/2004 | Wilson |
| 6,834,725 | B2 | 12/2004 | Whanger |
| 6,840,325 | B2 | 1/2005 | Stephenson |
| 6,851,473 | B2 | 2/2005 | Davidson |
| 6,851,560 | B2 | 2/2005 | Reig |
| 6,857,475 | B2 | 2/2005 | Johnson |
| 6,857,476 | B2 | 2/2005 | Richards |
| 6,886,634 | B2 | 5/2005 | Richards |
| 6,907,937 | B2 | 6/2005 | Whanger |
| 6,913,079 | B2 | 7/2005 | Tubel |
| 6,935,432 | B2 | 8/2005 | Nguyen |
| 6,957,703 | B2 | 10/2005 | Trott |
| 6,958,704 | B2 | 10/2005 | Vinegar |
| 6,967,589 | B1 | 11/2005 | Peters |
| 6,976,507 | B1 | 12/2005 | Webb |
| 7,007,756 | B2 | 3/2006 | Lerche |
| 7,011,101 | B2 | 3/2006 | Bowe |
| 7,011,152 | B2 | 3/2006 | Soelvik |
| 7,013,979 | B2 | 3/2006 | Richard |
| 7,017,662 | B2 | 3/2006 | Schultz |
| 7,025,134 | B2 | 4/2006 | Byrd |
| 7,038,332 | B2 | 5/2006 | Robison |
| 7,040,391 | B2 | 5/2006 | Leuthen |
| 7,043,937 | B2 | 5/2006 | Lifson |
| 7,059,401 | B2 | 6/2006 | Bode |
| 7,063,162 | B2 | 6/2006 | Oaling |
| 7,066,261 | B2 | 6/2006 | Vicente |
| 7,096,945 | B2 | 8/2006 | Richards |
| 7,100,686 | B2 | 9/2006 | Wittrisch |
| 7,108,083 | B2 | 9/2006 | Simonds |
| 7,114,560 | B2 | 10/2006 | Nguyen |
| 7,143,832 | B2 | 12/2006 | Freyer |
| 7,168,494 | B2 | 1/2007 | Starr |
| 7,185,706 | B2 | 3/2007 | Freyer |
| 7,199,480 | B2 | 4/2007 | Fripp |
| 7,207,386 | B2 | 4/2007 | Brannon |
| 7,213,650 | B2 | 5/2007 | Lehman |
| 7,213,681 | B2 | 5/2007 | Birchak |
| 7,216,738 | B2 | 5/2007 | Birchak |
| 7,258,169 | B2 | 8/2007 | Fripp |
| 7,290,606 | B2 | 11/2007 | Coronado |
| 7,318,471 | B2 | 1/2008 | Rodney |
| 7,322,409 | B2 | 1/2008 | Wittle |
| 7,322,416 | B2 | 1/2008 | Burris |
| 7,350,577 | B2 | 4/2008 | Howard |
| 7,363,967 | B2 | 4/2008 | Burris |
| 7,404,416 | B2 | 7/2008 | Schultz |
| 7,405,998 | B2 | 7/2008 | Webb |
| 7,409,999 | B2 | 8/2008 | Henriksen |
| 7,413,010 | B2 | 8/2008 | Blauch |
| 7,419,002 | B2 | 9/2008 | Oybevik |
| 7,426,962 | B2 | 9/2008 | Moen |
| 7,440,283 | B1 | 10/2008 | Rafie |
| 7,455,104 | B2 | 11/2008 | Duhon |
| 7,464,609 | B2 | 12/2008 | Fallet |
| 7,468,890 | B2 | 12/2008 | Lin |
| 7,469,743 | B2 | 12/2008 | Richards |
| 7,520,321 | B2 | 4/2009 | Hiron |
| 7,537,056 | B2 | 5/2009 | Macdougal |
| 7,578,343 | B2 | 8/2009 | Augustine |
| 7,621,336 | B2 | 11/2009 | Badalamenti |
| 7,644,773 | B2 | 1/2010 | Richard |
| 7,686,078 | B2 | 3/2010 | Khomynets |
| 7,699,102 | B2 | 4/2010 | Storm |
| 7,708,068 | B2 | 5/2010 | Hailey, Jr. |
| 7,780,152 | B2 | 8/2010 | Rao |
| 7,814,973 | B2 | 10/2010 | Dusterhoft |
| 7,828,067 | B2 | 11/2010 | Scott |
| 7,857,050 | B2 | 12/2010 | Zazovsky |
| 7,882,894 | B2 | 2/2011 | Nguyen |
| 7,918,272 | B2 | 4/2011 | Gaudette |
| 8,016,030 | B1 | 9/2011 | Prado Garcia |
| 8,025,103 | B1 | 9/2011 | Wolinsky |
| 8,083,935 | B2 | 12/2011 | Eia |
| 8,127,856 | B1 | 3/2012 | Nish |
| 8,191,627 | B2 | 6/2012 | Hamid |
| 8,196,665 | B2 | 6/2012 | Wolinsky |
| 8,235,128 | B2 | 8/2012 | Dykstra |
| 8,261,839 | B2 | 9/2012 | Fripp |
| 8,272,443 | B2 | 9/2012 | Watson |
| 8,276,669 | B2 | 10/2012 | Dykstra |
| 8,302,696 | B2 | 11/2012 | Williams et al. |
| 2002/0148607 | A1 | 10/2002 | Pabst |
| 2002/0150483 | A1 | 10/2002 | Ursan |
| 2003/0173086 | A1 | 9/2003 | Howard |
| 2004/0011561 | A1 | 1/2004 | Hughes |
| 2005/0110217 | A1 | 5/2005 | Wood |
| 2005/0150657 | A1 | 7/2005 | Howard |

(56) References Cited

U.S. PATENT DOCUMENTS

| | | | |
|---|---|---|---|
| 2005/0173351 | A1 | 8/2005 | Neofotistos |
| 2005/0214147 | A1 | 9/2005 | Schultz |
| 2006/0076150 | A1 | 4/2006 | Coronado |
| 2006/0113089 | A1 | 6/2006 | Henriksen |
| 2006/0131033 | A1 | 6/2006 | Bode |
| 2006/0185849 | A1 | 8/2006 | Edwards |
| 2007/0012454 | A1 | 1/2007 | Ross |
| 2007/0028977 | A1 | 2/2007 | Goulet |
| 2007/0045038 | A1 | 3/2007 | Han |
| 2007/0107719 | A1 | 5/2007 | Blacker |
| 2007/0169942 | A1 | 7/2007 | Loretz |
| 2007/0173397 | A1 | 7/2007 | Hinman |
| 2007/0193752 | A1 | 8/2007 | Kim |
| 2007/0246225 | A1 | 10/2007 | Hailey |
| 2007/0246407 | A1 | 10/2007 | Richards |
| 2007/0256828 | A1 | 11/2007 | Birchak |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0149323 | A1 | 6/2008 | Omalley |
| 2008/0169099 | A1 | 7/2008 | Pensgaard |
| 2008/0236839 | A1 | 10/2008 | Oddie |
| 2008/0251255 | A1 | 10/2008 | Forbes |
| 2008/0261295 | A1 | 10/2008 | Butler |
| 2008/0283238 | A1 | 11/2008 | Richards |
| 2008/0314578 | A1 | 12/2008 | Jackson |
| 2008/0314590 | A1 | 12/2008 | Patel |
| 2009/0000787 | A1 | 1/2009 | Hill |
| 2009/0008088 | A1 | 1/2009 | Schultz |
| 2009/0008090 | A1 | 1/2009 | Schultz |
| 2009/0009297 | A1 | 1/2009 | Shinohara |
| 2009/0009333 | A1 | 1/2009 | Bhogal |
| 2009/0009336 | A1 | 1/2009 | Ishikawa |
| 2009/0009412 | A1 | 1/2009 | Warther |
| 2009/0009437 | A1 | 1/2009 | Hwang |
| 2009/0009445 | A1 | 1/2009 | Lee |
| 2009/0009447 | A1 | 1/2009 | Naka |
| 2009/0020292 | A1 | 1/2009 | Loretz |
| 2009/0065197 | A1 | 3/2009 | Eslinger |
| 2009/0078427 | A1 | 3/2009 | Patel |
| 2009/0078428 | A1 | 3/2009 | Ali |
| 2009/0101342 | A1 | 4/2009 | Gaudette |
| 2009/0101344 | A1 | 4/2009 | Crow |
| 2009/0101352 | A1 | 4/2009 | Coronado |
| 2009/0101354 | A1 | 4/2009 | Holmes |
| 2009/0114395 | A1 | 5/2009 | Holmes |
| 2009/0120647 | A1 | 5/2009 | Turick |
| 2009/0133869 | A1 | 5/2009 | Clem |
| 2009/0145609 | A1 | 6/2009 | Holmes et al. |
| 2009/0151925 | A1 | 6/2009 | Richards |
| 2009/0159282 | A1 | 6/2009 | Webb |
| 2009/0188661 | A1 | 7/2009 | Bizon |
| 2009/0205834 | A1 | 8/2009 | Garcia et al. |
| 2009/0226301 | A1 | 9/2009 | Priestman et al. |
| 2009/0236102 | A1 | 9/2009 | Guest et al. |
| 2009/0250224 | A1 | 10/2009 | Wright et al. |
| 2009/0277639 | A1 | 11/2009 | Schultz |
| 2009/0277650 | A1 | 11/2009 | Casciaro |
| 2009/0301730 | A1 | 12/2009 | Gweily |
| 2010/0025045 | A1 | 2/2010 | Lake |
| 2010/0122804 | A1 | 5/2010 | Yang |
| 2010/0181251 | A1 | 7/2010 | Alspektor |
| 2010/0249723 | A1 | 9/2010 | Fangrow, Jr. |
| 2010/0300568 | A1 | 12/2010 | Faram |
| 2011/0017458 | A1 | 1/2011 | East |
| 2011/0042091 | A1 | 2/2011 | Dykstra |
| 2011/0042092 | A1 | 2/2011 | Fripp et al. |
| 2011/0042323 | A1 | 2/2011 | Sullivan |
| 2011/0079384 | A1 | 4/2011 | Russell |
| 2011/0139451 | A1 | 6/2011 | McKeen |
| 2011/0139453 | A1 | 6/2011 | Schultz |
| 2011/0186300 | A1 | 8/2011 | Dykstra et al. |
| 2011/0198097 | A1 | 8/2011 | Moen |
| 2011/0203671 | A1 | 8/2011 | Doig |
| 2011/0214871 | A1 | 9/2011 | Dykstra |
| 2011/0214876 | A1 | 9/2011 | Dykstra |
| 2011/0266001 | A1 | 11/2011 | Dykstra |
| 2011/0297384 | A1 | 12/2011 | Fripp |
| 2011/0297385 | A1 | 12/2011 | Dykstra |
| 2012/0048563 | A1 | 3/2012 | Holderman |
| 2012/0060624 | A1 | 3/2012 | Dykstra |
| 2012/0061088 | A1 | 3/2012 | Dykstra |
| 2012/0111577 | A1 | 5/2012 | Dykstra |
| 2012/0125120 | A1 | 5/2012 | Dykstra |
| 2012/0125626 | A1 | 5/2012 | Constantine |
| 2012/0138304 | A1 | 6/2012 | Dykstra |
| 2012/0145385 | A1 | 6/2012 | Lopez |
| 2012/0152527 | A1 | 6/2012 | Dykstra |
| 2012/0181037 | A1 | 7/2012 | Holderman |
| 2012/0211243 | A1 | 8/2012 | Dykstra |
| 2012/0234557 | A1 | 9/2012 | Dykstra |
| 2012/0255351 | A1 | 10/2012 | Dykstra |
| 2012/0255739 | A1 | 10/2012 | Fripp |
| 2012/0255740 | A1 | 10/2012 | Fripp |
| 2012/0305243 | A1 | 12/2012 | Hallundbaek et al. |
| 2013/0020088 | A1 | 1/2013 | Dyer et al. |
| 2013/0075107 | A1 | 3/2013 | Dykstra |

FOREIGN PATENT DOCUMENTS

| | | | |
|---|---|---|---|
| EP | 1672167 | A1 | 6/2006 |
| EP | 1857633 | | 11/2007 |
| EP | 1857633 | A2 | 11/2007 |
| WO | 0063530 | A1 | 10/2000 |
| WO | 0214647 | A2 | 2/2002 |
| WO | 03062597 | A1 | 7/2003 |
| WO | 2004012040 | A2 | 2/2004 |
| WO | 2004081335 | A2 | 9/2004 |
| WO | 2006015277 | A1 | 2/2006 |
| WO | 2008024645 | A2 | 2/2008 |
| WO | PCT/US08/075668 | | 9/2008 |
| WO | PCT/US09/075668 | | 9/2008 |
| WO | 2009081088 | A2 | 2/2009 |
| WO | 2009052076 | A2 | 4/2009 |
| WO | 2009052103 | A2 | 4/2009 |
| WO | 2009052149 | | 4/2009 |
| WO | PCT/US09/046404 | | 6/2009 |
| WO | 2009088292 | A1 | 7/2009 |
| WO | 2009088293 | A1 | 7/2009 |
| WO | 2009088624 | A2 | 7/2009 |
| WO | 2011002615 | A2 | 1/2011 |
| WO | WO 2011/097101 | A1 | 8/2011 |
| WO | WO 2011/100176 | A1 | 8/2011 |

OTHER PUBLICATIONS

Canadian Office Action, Application No. 2,737,998, Mail Date Jun. 21, 2013, 3 pages.

Flossert "Constant Flow Rate Product Brochure", Dec. 2002, 1 page.

Savkar, An Experimental Study of Switching in a Bistable Fluid Amplifier, University of Michigan, Dec. 1966.

Tesar, "Fluidic Valves for Variable-Configuration Gas Treatment, Chemical Engineering Research and Design", 83 (A9), pp. 1111-1121, Jun. 27, 2005.

"Fluidics", Microsoft Encarta Online Encylopedia, copyright 1997-2009.

Kirshner et al., "Design Theory of Fluidic Components", 1975, Academic Press, New York.

Kirshner, "Fluid Amplifiers", 1966, McGraw-Hill, New York.

Tesar, "New Ways of Fluid Flow Control in Automobiles: Experience with Exhaust Gas Aftertreatment Control", Seoul 2000 FISITA World Automotive Congress, Jun. 12-15, 2000, F2000H192.

Tesar, "Sampling by Fluidics and Microfluidics", Acta Polytechnica vol. 42 No. 2/2002, Jun. 24, 2005.

Angrist, "Fluid Control Device", Scientific American Dec. 1964, pp. 80-88, Dec. 1, 1964.

Freyer, "An Oil Selective Inflow Control System", SPE 78272, Oct. 2002.

International Search Report and Writting Opinion, PCT/US2011/058577, mail date Jul. 18, 2012.

(56) References Cited

OTHER PUBLICATIONS

"Apparatus and Method of Inducting Fluidic Oscillation in a Rotating Cleaning Nozzle," ip.com, dated Apr. 24, 2007, 3 pages.
Stephen L. Crow, Martin P. Coronado, Rustom K. Mody, "Means for Passive Inflow Control Upon Gas Breakthrough," SPE 102208, 2006 SPE Annual Technical Conference and Exhibition, San Antonio, Texas, U.S.A., Sep. 24-27, 2006, 6 pages.
Gebben, Vernon D., "Vortex Valve Performance Power Index," NASA TM X-52257, May 1967, pp. 1-14 plus 2 cover pages and Figures 1-8, National Aeronautics and Space Administration.
Haakh, Dr.-Ing. Frieder, "Vortex Chamber Diodes as Throttle Devices in Pipe Systems. Computation of Transient Flow," Journal of Hydraulic Research, 2003, vol. 41, No. 1, pp. 53-59.
Holmes, Allen B., et al., "A fluidic approach to the design of a mud pulser for bore-hole telemetry while drilling," DRCMS Code: 7-36AA-7100, HDL Project: A54735, Aug. 1979, pp. 1,2,5,6,9-27, and 29-37, Department of the Interior, U.S. Geological Survey, Washington, D.C.
Lee Precision Micro Hydraulics, Lee Restrictor Selector product brochure; Jan. 2011, 9 pages.
The Lee Company Technical Center, "Technical Hydraulic Handbook," 11th Edition, copyright 1971-2009, 7 pages Connecticut.
Weatherford product brochure entitled, "Application Answers—Combating Coning by Creating Even Flow Distribution in Horizontal Sand-Control Completions," 2005, 4 pages, Weatherford.
J.D Willingham, H.C. Tan, L.R. Norman, "Perforation Friction Pressure of Fracturing Fluid Slurries," SPE 25891, SPE Rocky Mountain Regional/Low Permeability Reservoirs Symposium, Denver, Co., U.S.A., Apr. 12-14, 1993, 14 pages.
Masahiro Takebayashi, Hiroshi Iwata, Akio Sakazume, Hiroaki Hata, "Discharge Characteristics of an Oil Feeder Pump Using Nozzle Type Fluidic Diodes for a Horizontal Compressor Depending on the Driving Speed," International Compressor Engineering Conference, Paper 597, 1988, 9 pages.
European Search Report, Application No. EP 13 18 2098, Mail Date Nov. 13, 2013, 8 pages.
Search and Examination Report, Jun. 24, 2015, Singapore Patent Application No. 2014010037, 23 pages.

AUTONOMOUS FLUID CONTROL DEVICE HAVING A RECIPROCATING VALVE FOR DOWNHOLE FLUID SELECTION

CROSS-REFERENCE TO RELATED APPLICATIONS

None.

FIELD OF INVENTION

The invention relates generally to methods and apparatus for selective control of fluid flow from a formation in a hydrocarbon bearing subterranean formation into a production string in a wellbore. More particularly, the invention relates to methods and apparatus for controlling the flow of fluid based on some characteristic of the fluid flow, such as viscosity, by utilizing a reciprocating member, such as a hollow-bore piston having a screen covering or choke at one end of the bore, the reciprocating member moved to an open position by the force of a flowing fluid depending on a characteristic of the fluid, for example, by the force of a relatively higher viscosity fluid.

BACKGROUND OF INVENTION

During the completion of a well that traverses a hydrocarbon bearing subterranean formation, production tubing and various equipment are installed in the well to enable safe and efficient production of the fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more inflow control devices with the completion string.

Production from any given production tubing section can often have multiple fluid components, such as natural gas, oil and water, with the production fluid changing in proportional composition over time. Thereby, as the proportion of fluid components changes, the fluid flow characteristics will likewise change. For example, when the production fluid has a proportionately higher amount of natural gas, the viscosity of the fluid will be lower and density of the fluid will be lower than when the fluid has a proportionately higher amount of oil. It is often desirable to reduce or prevent the production of one constituent in favor of another. For example, in an oil-producing well, it may be desired to reduce or eliminate natural gas production and to maximize oil production. While various downhole tools have been utilized for controlling the flow of fluids based on their desirability, a need has arisen for a flow control system for controlling the inflow of fluids that is reliable in a variety of flow conditions. Further, a need has arisen for a flow control system that operates autonomously, that is, in response to changing conditions downhole and without requiring signals from the surface by the operator. Similar issues arise with regard to injection situations, with flow of fluids going into instead of out of the formation.

SUMMARY OF THE INVENTION

The invention presents an apparatus and method for autonomously controlling flow of fluid in a subterranean well, wherein a fluid characteristic of the fluid flow changes over time. In one embodiment, an autonomous reciprocating member has a fluid flow passageway there through and a primary outlet and at least one secondary outlet. A flow restrictor, such as a choke or screen, is positioned to restrict, for example, a relatively higher viscosity fluid flow through the primary outlet of the reciprocating member. A vortex chamber having a primary inlet and at least one secondary inlet is adjacent the reciprocating member. The reciprocating member moves between a first position wherein fluid flow is directed primarily through the primary outlet of the reciprocating member and into the primary inlet of the vortex assembly, and a second position wherein fluid flow is directed primarily through the at least one secondary outlet of the reciprocating member and into the at least one secondary inlet of the vortex assembly.

The reciprocating member moves in response to changes in the fluid characteristic. For example, when the fluid is of relatively low viscosity, it flows through the reciprocating member passageway, the reciprocating member primary outlet and restrictor relatively freely. In the first position, the secondary outlets of the reciprocating member are substantially blocked. As the fluid changes to a higher viscosity, fluid flow is restricted by the restrictor and the reciprocating member is moved to the second position by the resulting pressure. In the second position, the secondary outlets of the reciprocating member are no longer blocked and fluid now flows relatively freely through them.

The movement of the reciprocating member alters the fluid flow pattern in the adjacent vortex chamber. In the first position, when fluid flows primarily through the primary outlet, the fluid is directed tangentially into the vortex, causing spiraling flow, increased fluid velocity and a greater pressure drop across the vortex. In the second position, fluid flow is directed such that the resulting fluid flow in the vortex is primarily radial, the velocity is reduced and the pressure drop across the vortex is reduced.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

Figure 1:
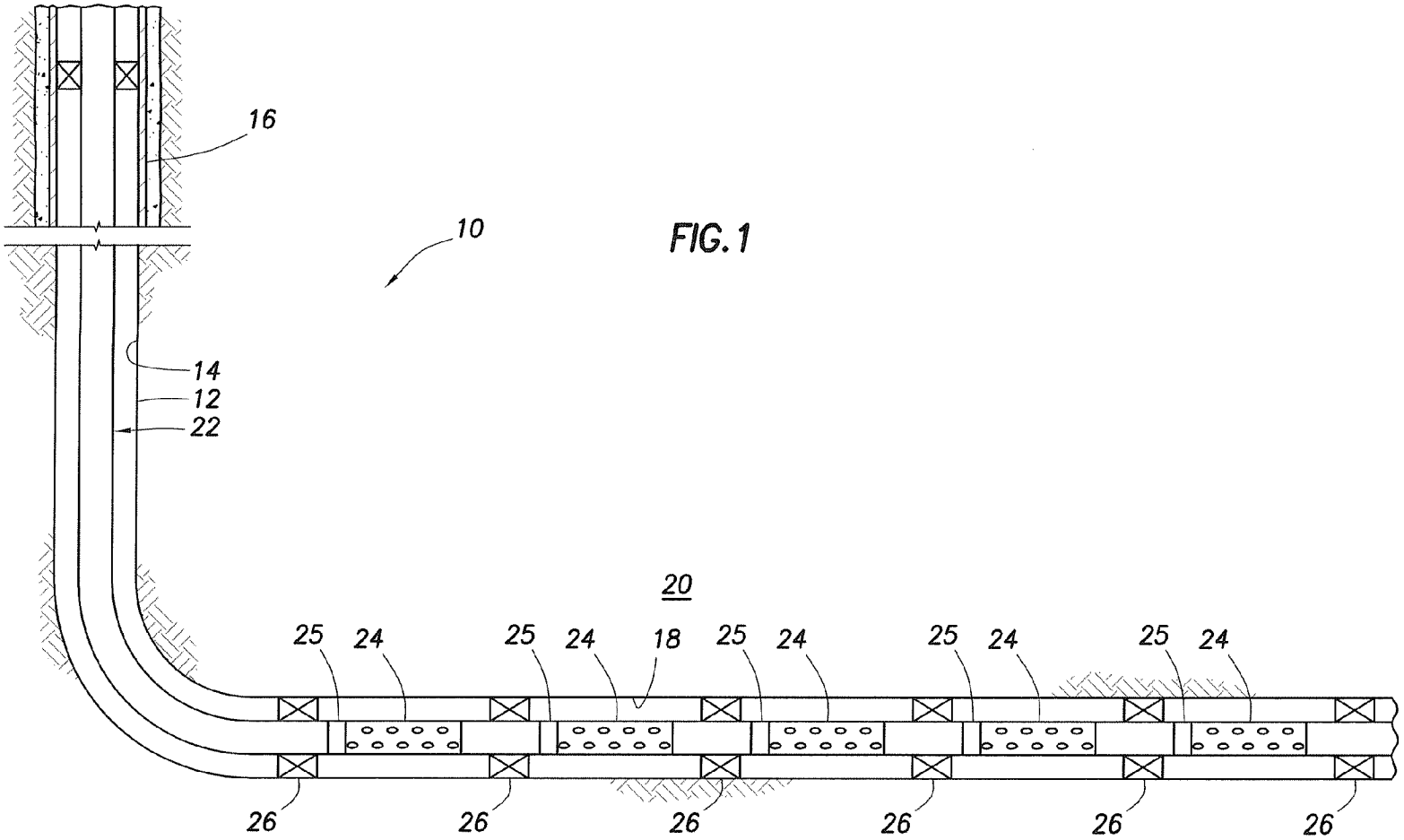
FIG. 1 is a schematic illustration of a well system including a plurality of autonomous fluid flow control systems according to an embodiment of the invention.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Descriptions of fluid flow control using autonomous flow control devices and their application can be found in the following U.S. Patents and Patent Applications, each of which are hereby incorporated herein in their entirety for all purposes: U.S. Pat. No. 7,404,416, entitled "Apparatus and Method For Creating Pulsating Fluid Flow, And Method of Manufacture For the Apparatus," to Schultz, filed Mar. 25, 2004; U.S. Pat. No. 6,976,507, entitled "Apparatus for Creating Pulsating Fluid Flow," to Webb, filed Feb. 8, 2005; U.S. patent application Ser. No. 12/635,612, entitled "Fluid Flow Control Device," to Schultz, filed Dec. 10, 2009; U.S. patent application Ser. No. 12/770,568, entitled "Method and Apparatus for Controlling Fluid Flow Using Movable Flow Diverter Assembly," to Dykstra, filed Apr. 29, 2010; U.S. patent application Ser. No. 12/700,685, entitled "Method and Apparatus for Autonomous Downhole Fluid Selection With Pathway Dependent Resistance System," to Dykstra, filed Feb. 4, 2010; U.S. patent application Ser. No. 12/750,476, entitled "Tubular Embedded Nozzle Assembly for Controlling the Flow Rate of Fluids Downhole," to Syed, filed Mar. 30, 2010; U.S. patent application Ser. No. 12/791,993, entitled "Flow Path Control Based on Fluid Characteristics to Thereby Variably Resist Flow in a Subterranean Well," to Dykstra, filed Jun. 2, 2010; U.S. patent application Ser. No. 12/792,095, entitled "Alternating Flow Resistance Increases and Decreases for Propagating Pressure Pulses in a Subterranean Well," to Fripp, filed Jun. 2, 2010; U.S. patent application Ser. No. 12/792,117, entitled "Variable Flow Resistance System for Use in a Subterranean Well," to Fripp, filed Jun. 2, 2010; U.S. patent application Ser. No. 12/792,146, entitled "Variable Flow Resistance System With Circulation Inducing Structure Therein to Variably Resist Flow in a Subterranean Well," to Dykstra, filed Jun. 2, 2010; U.S. patent application Ser. No. 12/879,846, entitled "Series Configured Variable Flow Restrictors For Use In A Subterranean Well," to Dykstra, filed Sep. 10, 2010; U.S. patent application Ser. No. 12/869,836, entitled "Variable Flow Restrictor For Use In A Subterranean Well," to Holderman, filed Aug. 27, 2010; U.S. patent application Ser. No. 12/958,625, entitled "A Device For Directing The Flow Of A Fluid Using A Pressure Switch," to Dykstra, filed Dec. 2, 2010; U.S. patent application Ser. No. 12/974,212, entitled "An Exit Assembly With a Fluid Director for Inducing and Impeding Rotational Flow of a Fluid," to Dykstra, filed Dec. 21, 2010; U.S. patent application Ser. No. 12/983,144, entitled "Cross-Flow Fluidic Oscillators for use with a Subterranean Well," to Schultz, filed Dec. 31, 2010; U.S. patent application Ser. No. 12/966,772, entitled "Downhole Fluid Flow Control System and Method Having Direction Dependent Flow Resistance," to Jean-Marc Lopez, filed Dec. 13, 2010; U.S. patent application Ser. No. 12/983,153, entitled "Fluidic Oscillators For Use With A Subterranean Well (includes vortex)," to Schultz, filed Dec. 31, 2010; U.S. patent application Ser. No. 13/084,025, entitled "Active Control for the Autonomous Valve," to Fripp, filed Apr. 11, 2011; U.S. patent application Ser. No. 61/473,700, entitled "Moving Fluid Selectors for the Autonomous Valve," to Fripp, filed Apr. 8, 2011; U.S. Patent Application Ser. No. 61/473,699, entitled "Sticky Switch for the Autonomous Valve," to Fripp, filed Apr. 8, 2011; and U.S. patent application Ser. No. 13/100,006, entitled "Centrifugal Fluid Separator," to Fripp, filed May 3, 2011.

FIG. 1 is a schematic illustration of a well system, indicated generally 10, including a plurality of autonomous flow control systems embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, which extends through a hydrocarbon-bearing subterranean formation 20. As illustrated, substantially horizontal section 18 of wellbore 12 is open hole. While shown here in an open hole, horizontal section of a wellbore, the invention will work in any orientation, and in open or cased hole. The invention will also work equally well with injection systems, as will be discussed supra.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous flow control systems 25 and a plurality of production tubing sections 24. At either end of each production tubing section 24 is a packer 26 that provides a fluid seal between tubing string 22 and the wall of wellbore 12. The space in-between each pair of adjacent packers 26 defines a production interval.

In the illustrated embodiment, each of the production tubing sections 24 includes sand control capability. Sand control screen elements or filter media associated with production tubing sections 24 are designed to allow fluids to flow there through but prevent particulate matter of sufficient size from flowing there through. While the invention does not need to have a sand control screen associated with it, if one is used, then the exact design of the screen element associated with fluid flow control systems is not critical to the present invention. There are many designs for sand control screens that are well known in the industry, and will not be discussed here in detail. Also, a protective outer shroud having a plurality of perforations there through may be positioned around the exterior of any such filter medium.

Through use of the flow control systems 25 of the present invention in one or more production intervals, some control over the volume and composition of the produced fluids is enabled. For example, in an oil production operation if an undesired fluid component, such as water, steam, carbon dioxide, or natural gas, is entering one of the production intervals, the flow control system in that interval will autonomously restrict or resist production of fluid from that interval.

The term "natural gas" or "gas" as used herein means a mixture of hydrocarbons (and varying quantities of non-hydrocarbons) that exist in a gaseous phase at room temperature and pressure. The term does not indicate that the natural gas is in a gaseous phase at the downhole location of the inventive systems. Indeed, it is to be understood that the flow control system is for use in locations where the pressure and temperature are such that natural gas will be in a mostly liquefied state, though other components may be present and some components may be in a gaseous state. The inventive concept will work with liquids or gases or when both are present.

The fluid flowing into the production tubing section 24 typically comprises more than one fluid component. Typical components are natural gas, oil, water, steam or carbon dioxide. Steam and carbon dioxide are commonly used as injection fluids to drive the hydrocarbon towards the production tubular, whereas natural gas, oil and water are typically found in situ in the formation. The proportion of these components in the fluid flowing into each production tubing section 24 will vary over time and based on conditions within the formation and wellbore. Likewise, the composition of the fluid flowing into the various production tubing sections throughout the length of the entire production string can vary significantly from section to section. The flow control system is designed to reduce or restrict production from any particular interval when it has a higher proportion of an undesired component.

Accordingly, when a production interval corresponding to a particular one of the flow control systems produces a greater proportion of an undesired fluid component, the flow control system in that interval will restrict or resist production flow from that interval. Thus, the other production intervals which are producing a greater proportion of desired fluid component, in this case oil, will contribute more to the production stream entering tubing string 22. In particular, the flow rate from formation 20 to tubing string 22 will be less where the fluid must flow through a flow control system (rather than simply flowing into the tubing string). Stated another way, the flow control system creates a flow restriction on the fluid.

Though FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals in the wellbore or may be in the tubing passageway to address multiple production intervals.

Figure 2:
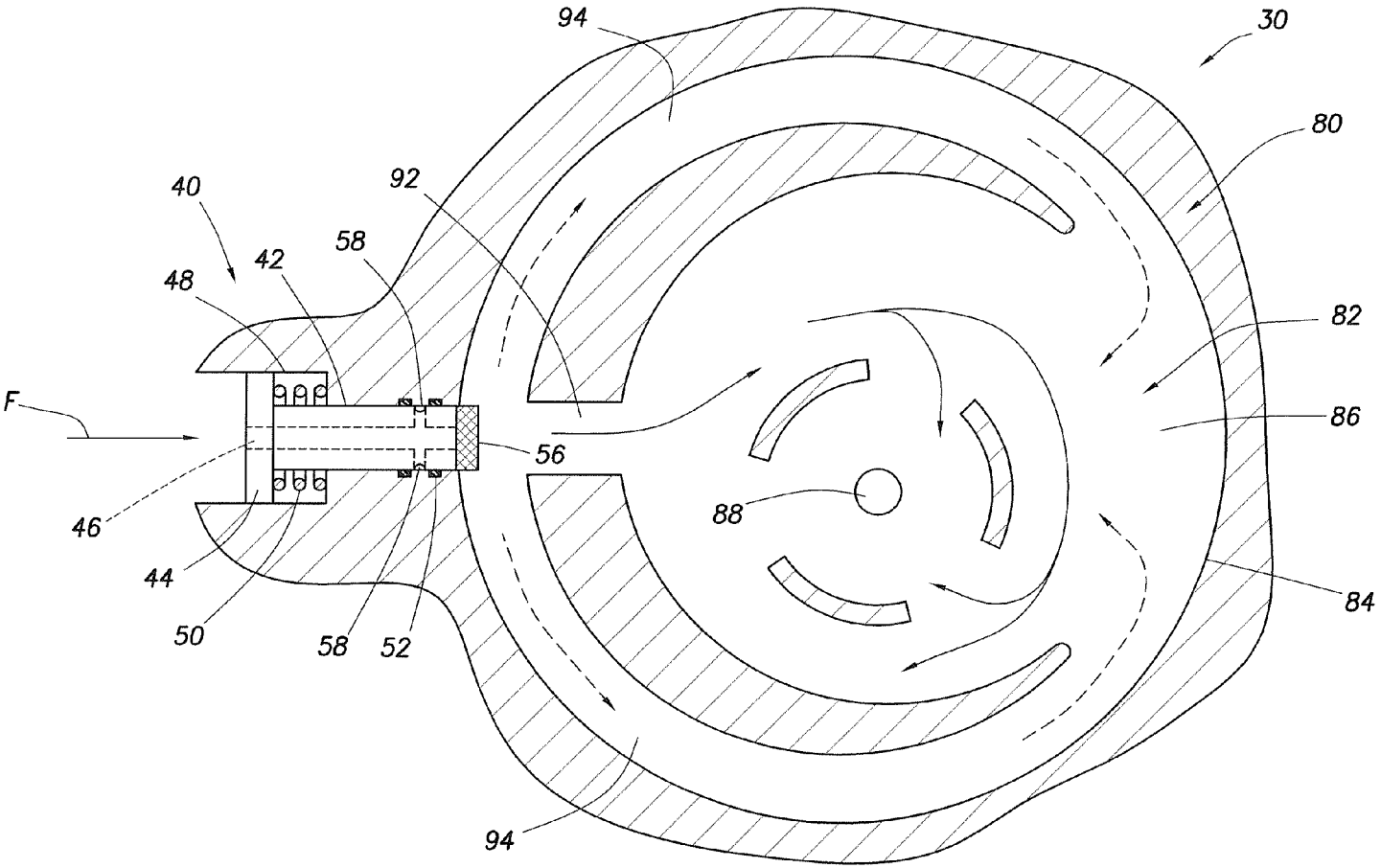
FIG. 2 is a top view schematic of an autonomous fluid flow control device utilizing a vortex assembly and autonomously reciprocating assembly embodying principles of the present invention.

FIG. 2 is a top plan view of a fluid control device 30 according to an embodiment of the invention showing fluid flow paths there through. The fluid control device 30 has a reciprocating assembly 40 for directing fluid flow into a fluid flow system 80.

A preferred embodiment of the fluid flow chamber 80 is seen in FIG. 2. The chamber is a vortex chamber 82, having a peripheral wall 84, a top surface (not shown), and a bottom surface 86 sloped to induce a rotational or spiral flow. Fluid flows through the vortex outlet 88, typically located proximate the center of the bottom surface 86. The fluid flow system 80 can include additional features. For example, directional elements 90 can be added, such as vanes, grooves, etc. In the embodiment seen in FIG. 2, the fluid flow system has multiple inlets, namely, a primary inlet 92, and two secondary inlets 94. The inlets can be passageways, as shown.

Primary inlet 92 directs fluid flow into the vortex chamber 82 to induce spiral or centrifugal flow in the chamber. In a preferred embodiment, the primary inlet 92 directs flow into the vortex chamber tangentially to increase such flow. Consequently, there is a greater pressure drop across the chamber (from the chamber inlets to the chamber outlet). Fluid flow along the primary inlet 92 and through the vortex chamber 82 is seen in FIG. 2 as solid arrows for ease of reference.

The secondary inlets 94, conversely, are designed to direct fluid into the vortex chamber 82 to inhibit, or result in relatively less spiral or centrifugal flow. In the embodiment shown in FIG. 2, the secondary inlets 94 direct flow into the vortex chamber 82 in opposing flow paths, such that the flows tend to interfere or "cancel each other out" and inhibit centrifugal flow. Instead, the fluid directed through the secondary inlets 94 flows through the vortex outlet 88 with no or minimal spiraling. Preferably, the fluid flow from the secondary inlets 94 flows radially through the vortex chamber 82. Flow directed through the secondary inlets 94 produces a relatively lower pressure drop across the chamber. Fluid flow along the secondary inlets 94 and then through the vortex chamber 82 are shown ion dashed arrows for ease of reference.

Figure 3:
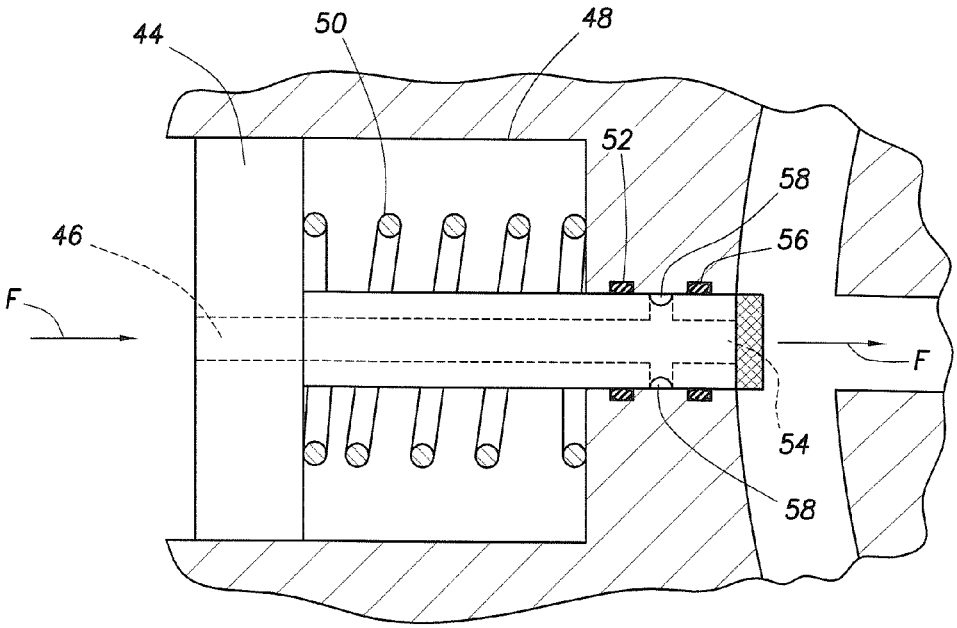
FIG. 3 is a detail view of an embodiment of the reciprocating assembly in a first position embodying principles of the present invention.
Figure 4:
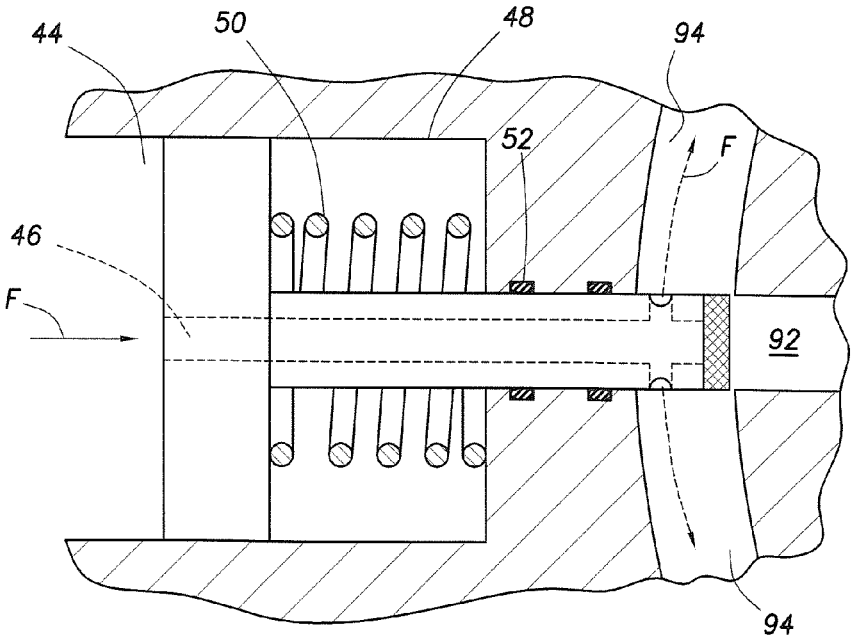
FIG. 4 is a top view schematic of an alternate embodiment of the invention.

The reciprocating assembly 40 is shown in a preferred embodiment in FIGS. 2-4. FIG. 3 is a detailed view of the reciprocating assembly in a first position wherein fluid flow is directed into the fluid flow chamber to create a relatively higher pressure drop across the chamber. For example, in a vortex chamber as shown, when the reciprocating assembly is in the first position, fluid is directed into the vortex chamber 82 through the primary inlet 92, preferably tangentially, to create a centrifugal flow about the chamber as indicated by the solid arrows. FIG. 4 is a detailed view of the reciprocating assembly in a second position, wherein fluid flow is directed into the fluid flow chamber 82 to create a relatively low pressure drop across the chamber. For example, in a vortex chamber as shown, when the reciprocating assembly is in the second position, fluid is directed into the vortex chamber 82 through the secondary inlets 94 to inhibit spiral or centrifugal flow through the chamber. Such flow preferably induces radial flow through the chamber 82, as indicated by the dashed arrows.

In the preferred embodiment seen in FIG. 2-4, the reciprocating assembly 40 includes a reciprocating member 42, such as piston 44. The piston 44 defines a reciprocating member passageway 46, such as the hollow-bore shown. The piston 44 reciprocates within cylinder 48. The piston 44 is biased towards the first position, as shown in FIGS. 2 and 3, by a biasing member 50, such as a spring. Other biasing mechanisms are known in the art. Seals 52 can be provided to prevent or reduce flow around the piston and can be mounted in the cylinder walls, as shown, or on the piston periphery. The reciprocating member 42 moves to a second position, such as when piston 44 is in the position seen in FIG. 4.

The reciprocating member 42 defines at least one fluid flow passageway 46 there through. In the preferred embodiment the passageway 46 is a hollow-bore passageway through the piston. Fluid flow enters the reciprocating member passageway and flows toward the fluid flow system 80. The hollow-bore passageway 46 leads to multiple outlets. The primary outlet 54 has a flow restrictor 56 positioned to restrict fluid flow through the primary outlet. The flow restrictor 56 can be a choke, a screen, or other mechanism, as is known in the art. The flow restrictor is shown positioned over the end of the primary outlet but can be positioned elsewhere, such as within the outlet passageway. The flow restrictor 56 is designed to allow fluid flow there through when the fluid is of a relatively low viscosity, such as water or natural gas. The flow restrictor 56 restricts or prevents flow there through when the fluid is of relatively higher viscosity, such as oil, for example. In the first position, flow through secondary outlets 58 is restricted or prevented. For example, in the embodiment shown, flow through the secondary outlets 58 is restricted by the wall of the cylinder 48. FIG. 3 shows the fluid "F" flowing into the reciprocating member passageway and through the primary outlet 54 and restrictor 56.

In FIG. 4, the reciprocating member is in the second position. The piston 44 has moved along the cylinder 48, compressing the biasing member 50. Fluid flow is now allowed along secondary outlets 58. As can be seen, fluid F flowing through the piston 44 is now directed through the secondary outlets 58 and into the secondary inlets 94 of the fluid flow system 80.

Movement of the reciprocating member 42 is autonomous and dependent on a characteristic of the fluid flowing there through, which is expected to vary over time during use. In the preferred embodiment shown, when the fluid is of a low viscosity, it simply flows through the reciprocating member with relatively little resistance provided by the restrictor and the reciprocating member remains in the first position. When the characteristic of the fluid changes, for example to a higher viscosity, the restrictor 56 restricts fluid flow, raising fluid pressure behind the restrictor, and resulting in movement of the reciprocating member to the second position. In the second position, fluid flows primarily through secondary outlets, such as secondary outlets 58. Although some fluid may flow through the restrictor 56 and through inlet 92 of the vortex assembly, fluid flow is such that it will not induce significant (or any) centrifugal or spiraling flow in the chamber. In a preferred embodiment, a portion of the reciprocating member, such as the restrictor 56, moves adjacent to or into the inlet 92, further reducing or preventing flow through the primary inlet 92.

As the fluid characteristic changes again, for example to a relatively lower viscosity, the biasing member returns the reciprocating member to its first position. Thus the changing characteristic of the fluid or fluid flow autonomously changes the position of the reciprocating member and alters the flow path through the fluid flow system 80.

Alternate embodiments of the reciprocating member passageway can include multiple passageways arranged through the reciprocating member, along grooves or indentations along the exterior of the reciprocating member, etc. The secondary passageway(s) can be radial, as shown, or take other forms as to provide an alternate fluid flow path as the reciprocating member moves. Similarly, the reciprocating member 42 is shown as a piston, but can take alternative forms, such as a sliding member, reciprocating ball, etc., as will be recognized by those of skill in the art.

It is specifically asserted that the reciprocating assembly can be used with alternate fluid flow systems 80. The incorporated references provide examples of such flow systems.

Figure 5:
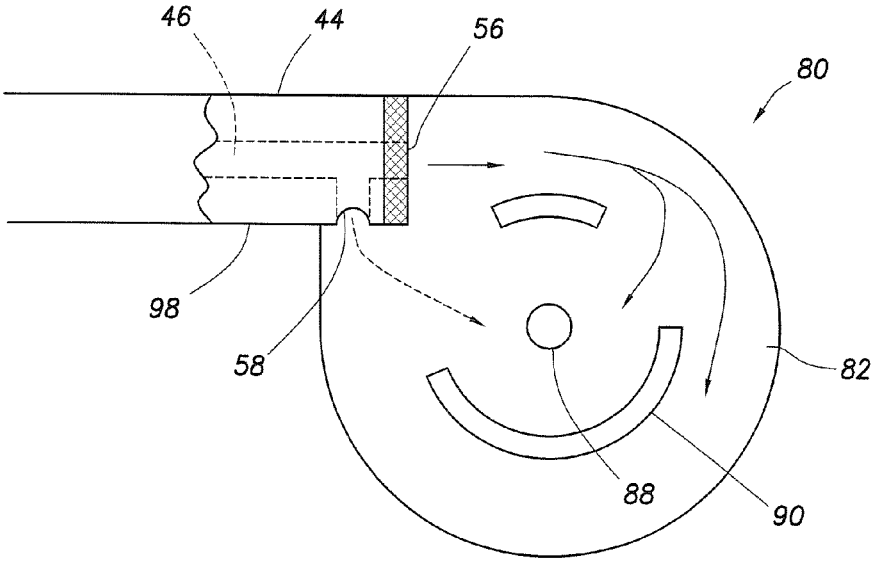
FIGS. 5 and 6 are top view schematics of alternate embodiments of the invention.
Figure 6:
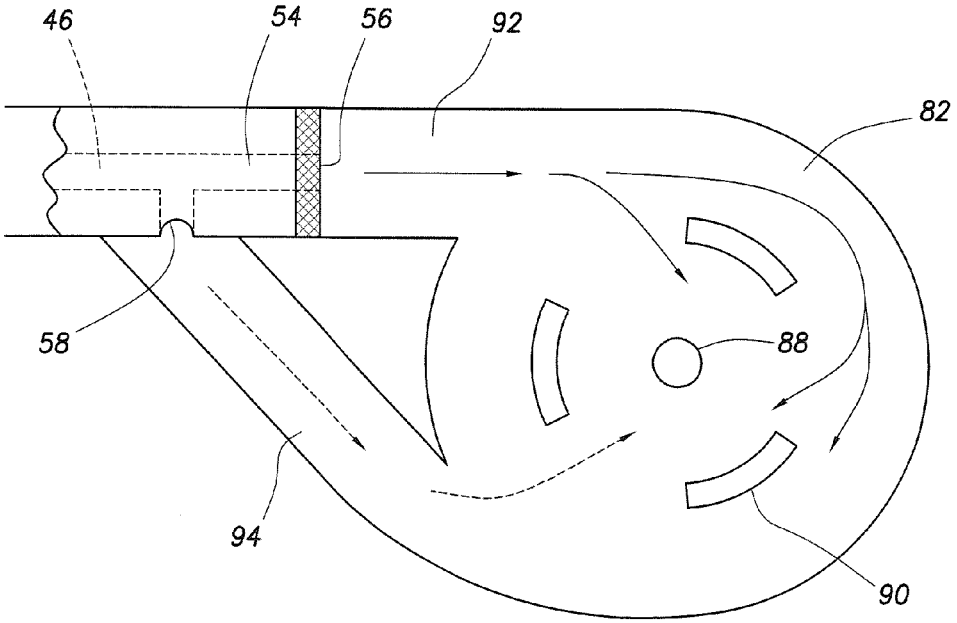

FIGS. 5 and 6 are alternate exemplary embodiments of fluid flow systems 80 which can be used in conjunction with the reciprocating assembly described herein. In FIG. 5, the fluid flow system 80, with vortex chamber 82, vortex outlet 88 and directional elements 90, has a single inlet 98. Fluid flow is directed through the primary outlet 56 of the reciprocating piston 44, and tangentially into the vortex chamber 82, as indicated by solid arrows. When the piston 44 is in the second position, as seen in FIG. 5, the fluid flows through secondary outlet 58 and is directed such that it flows substantially radially through the vortex chamber 82. Thus the same or similar flow patterns are achieved with a different design.

In FIG. 6, when the fluid is of a relatively low viscosity, fluid flow is directed through the piston 44, along passageway 46, through the primary outlet 54 and restrictor 56, and into a primary inlet 92 of the vortex assembly, thereby inducing spiral or centrifugal flow in the vortex chamber. When the fluid changes characteristics, such as to a high viscosity, the piston 44 is moved to the second position, and fluid flows primarily through the secondary outlet 58 and into the secondary inlet 94 of the fluid flow assembly. Thus, the relatively higher viscosity fluid is directed, as indicated by the dashed arrows, primarily radially through the vortex chamber 82 and through vortex outlet 88.

It can be seen that the inventive features herein can be utilized with various fluid flow systems 80, having single or multiple inlets, single or multiple outlets, etc., as will be understood by those of skill in the art.

The description above of the assembly in use is provided in an exemplary embodiment wherein production fluid from the formation is directed through the assembly. The production fluid can flow through screens, passageways, tubular sections, annular passageways, etc., before and after flowing through the assembly. The assembly can also be used for injection and other completion activities, as explained in incorporated references and as understood by those of skill in the art. The exemplary use is described in terms of restricting fluid flow such as water of natural gas and allowing flow of oil. The invention can be used to restrict fluid flow based on viscosity or other fluid characteristics, and can be used to restrict flow of an undesired fluid while allowing flow of a desired fluid. For example, water flow can be restricted while natural gas flow is allowed, etc. In injection uses, for example, steam can be allowed while water is restricted.

The invention can also be used with other flow control systems, such as inflow control devices, sliding sleeves, and other flow control devices that are already well known in the industry. The inventive system can be either parallel with or in series with these other flow control systems.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. An apparatus for autonomously controlling flow of fluid in a subterranean well, wherein a fluid characteristic of the fluid flow changes over time, comprising:

a vortex assembly defining a vortex chamber and having a primary inlet and at least one secondary inlet;

an autonomous reciprocating assembly having a reciprocating member, the reciprocating member defining a fluid flow passageway and having a primary outlet and at least one secondary outlet, the reciprocating member comprising a reciprocating piston positioned in a cylinder wherein a wall of the cylinder restricts flow through the at least one secondary outlet when the reciprocating assembly is in a first position, wherein the primary outlet is positioned at a first end of the piston, and wherein the at least one secondary outlet includes a radial passageway terminating at a radial wall of the piston, and wherein a flow restrictor is positioned at the first end of the piston such that the flow restrictor is disposed within the primary inlet of the vortex chamber when the reciprocating assembly is in a second position, and wherein the at least one secondary outlet is disposed within the at least one secondary inlet of the vortex chamber when the reciprocating assembly is in the second position, and wherein the primary inlet and at least one secondary inlet are distinct from one another; and the reciprocating assembly movable between the first position wherein fluid flow is directed primarily through the primary outlet of the reciprocating member and into the primary inlet of the vortex assembly, and the second position wherein fluid flow is directed primarily through the at least one secondary outlet of the reciprocating member and into the at least one secondary inlet of the vortex assembly, the reciprocating member movable in response to changes in the fluid characteristic.

2. An apparatus as in claim 1, wherein the flow restrictor is positioned to restrict fluid flow through the primary outlet of the reciprocating member and to permit substantially unrestricted flow through the at least one secondary outlet of the reciprocating member.

3. An apparatus as in claim 2, wherein the flow restrictor includes a viscosity dependent choke.

4. An apparatus as in claim 2, wherein the flow restrictor includes a viscosity dependent screen.

5. An apparatus as in claim 1, wherein the secondary outlet includes multiple outlet passageways.

6. An apparatus as in claim 1, wherein the primary inlet of the vortex assembly is positioned to induce fluid flowing there through primarily into a spiral flow in the vortex chamber.

7. An apparatus as in claim 1, wherein the at least one secondary inlet to the vortex chamber includes two opposed secondary inlets.

8. An apparatus as in claim 1, wherein the characteristic of the fluid which changes over time is viscosity.

9. An apparatus as in claim 1, further comprising a downhole tool, the vortex assembly positioned in the downhole tool.

10. A method for controlling fluid flow in a subterranean well having a wellbore extending there through, the method comprising the steps of:

flowing fluid through a downhole tool;

flowing fluid through an autonomous reciprocating member and through a flow restrictor attached thereto;

flowing fluid from the flow restrictor into a primary inlet of a vortex chamber positioned in the downhole tool, thereby creating a flow pattern in the vortex chamber;

moving the autonomous reciprocating member in response to a change in a characteristic of the fluid such that the flow restrictor is moved within the primary inlet of the vortex chamber, and such that at least one secondary outlet of the autonomous reciprocating member that is distinct from the primary inlet is moved into at least one secondary inlet of the vortex chamber; and altering the fluid flow pattern through the vortex chamber by flowing fluid through the at least one secondary outlet in response to moving the autonomous reciprocating member.

11. A method as in claim 10, wherein the step of flowing fluid into a vortex chamber further includes the step of flowing fluid primarily through a tangential inlet of the vortex chamber.

12. A method as in claim 10, wherein the step of altering the fluid flow pattern further comprises the step of altering the fluid flow pattern from primarily centrifugal to primarily radial flow in the vortex chamber by distributing flow between distinct tangential and radial inlets of the vortex chamber in response to a position of the autonomous reciprocating member.

13. A method as in claim 10, further comprising the step of preventing fluid flow through the primary inlet to the vortex chamber.

14. A method as in claim 10, wherein the step of moving the autonomous reciprocating member results in reduced fluid flow through the flow restrictor.

15. A method as in claim 14, wherein the autonomous reciprocating member has a primary outlet and multiple secondary outlets, and moving the autonomous reciprocating member results in fluid flow primarily through the secondary outlets.

16. A method as in claim 10, wherein the fluid characteristic is viscosity.

17. A method as in claim 10, wherein the step of moving the autonomous reciprocating member further comprises the step of moving the autonomous reciprocating member alternately toward a closed position and toward an open position in response to changes in fluid characteristic over time.

* * * * *